US008181985B2

(12) United States Patent
Mangold et al.

(10) Patent No.: US 8,181,985 B2
(45) Date of Patent: May 22, 2012

(54) SKI BINDING

(75) Inventors: Michael Mangold, Grainau (DE); Thomas Tchorsch, Garmisch-Partenkirchen (DE); Markus Krumbeck, Garmisch-Partenkirchen (DE)

(73) Assignee: Marker Deutschland GmbH (DE)

( * ) Notice: Subject to any disclaimer, the term of this patent is extended or adjusted under 35 U.S.C. 154(b) by 847 days.

(21) Appl. No.: 12/094,932

(22) PCT Filed: Nov. 24, 2006

(86) PCT No.: PCT/EP2006/068878

§ 371 (c)(1),
(2), (4) Date: Jul. 18, 2008

(87) PCT Pub. No.: WO2007/060219

PCT Pub. Date: May 31, 2007

(65) Prior Publication Data

US 2008/0309053 A1 Dec. 18, 2008

(30) Foreign Application Priority Data

Nov. 25, 2005 (DE) ..... 10 2005 056 526

(51) Int. Cl.
*A63C 9/00* (2006.01)

(52) U.S. Cl. ..... 280/614; 280/617; 280/618; 280/613

(58) Field of Classification Search ..... 280/611, 280/613, 614, 617, 618
See application file for complete search history.

(56) References Cited

U.S. PATENT DOCUMENTS

| | | | | |
|---|---|---|---|---|
| 3,874,685 | A * | 4/1975 | Von Besser | 280/618 |
| 3,877,712 | A * | 4/1975 | Weckeiser | 280/614 |
| 3,930,660 | A | 1/1976 | Frechin | |
| 4,029,336 | A | 6/1977 | Haimerl | |
| 4,500,108 | A * | 2/1985 | Johnson, III | 280/614 |
| 4,519,625 | A * | 5/1985 | Luitz et al. | 280/633 |
| 4,674,766 | A * | 6/1987 | Ramer | 280/614 |
| 6,431,578 | B2 * | 8/2002 | Pedersen et al. | 280/626 |

FOREIGN PATENT DOCUMENTS

| | | |
|---|---|---|
| DE | 2401639 | 9/1974 |
| FR | 2741543 | 5/1997 |

OTHER PUBLICATIONS

English Abstract for FR2741543.

* cited by examiner

*Primary Examiner* — Katy M Ebner
(74) *Attorney, Agent, or Firm* — Rader, Fishman & Grauer PLLC

(57) ABSTRACT

A ski binding for downhill skiing and cross-country skiing has a plate which can be pivoted upwards in the front region about an axis located transversely to the longitudinal direction of the ski. A front ski binding and a rear heel holder for a ski boot or cross-country ski boot are fastened on the plate. At least one catch element which is arranged in front of, or in the region of, the rear sole holder can be used to secure the plate, in its rear region, on the abutment fitted on the ski. In addition, at least one catch element is arranged in the front region of the plate. The plate is fixed on the ski, and reinforced, in the manner of a conventional downhill ski binding by the further catch element in the front region of the ski binding and, in the locked state, is anchored at the front end and at the rear end, and at a number of locations therebetween, on parts of the ski or parts which have been fixed to the ski.

20 Claims, 7 Drawing Sheets

SKI BINDING

CROSS REFERENCE TO RELATED APPLICATIONS

Figure 1:
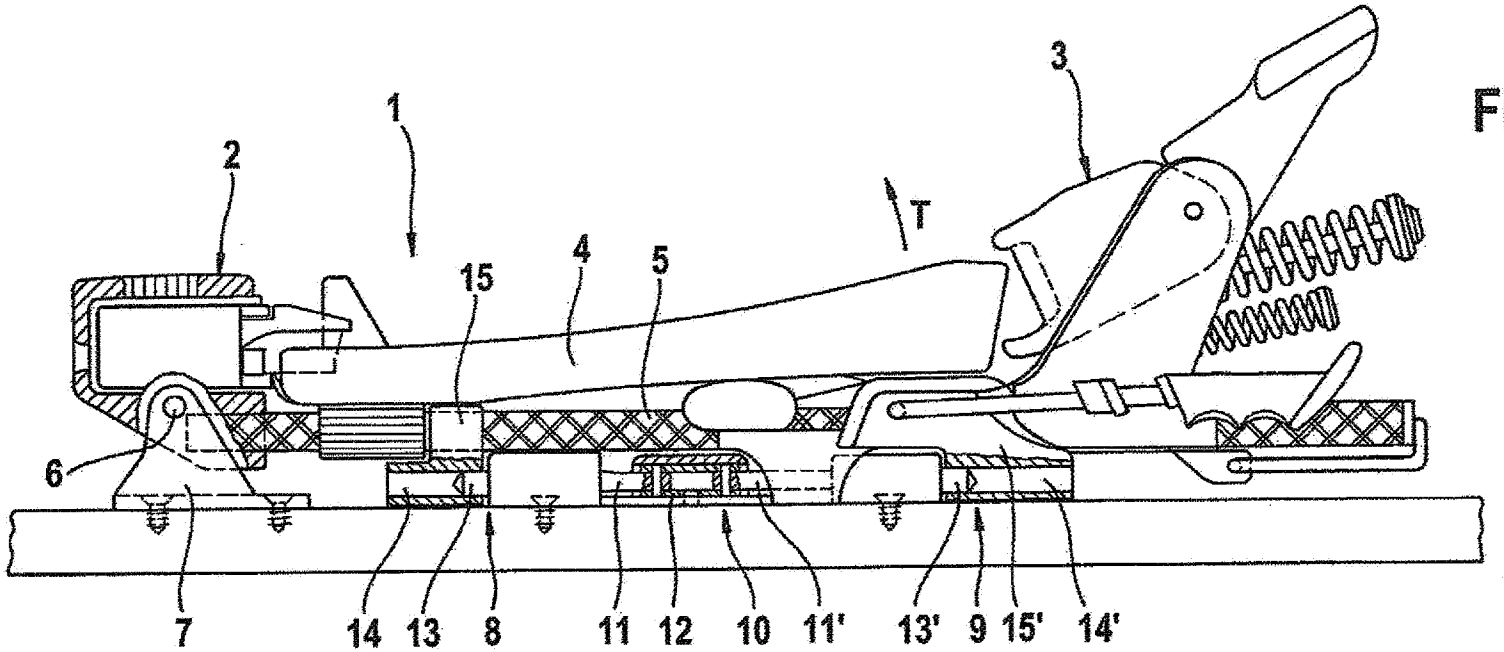

This application claims priority based on DE 102005056526.3 filed Nov. 25, 2005, and International Application PCT/EP2006/068878 filed Nov. 24, 2006 which are hereby incorporated by reference in their entirety.

TECHNICAL FIELD

The invention is concerned with a ski binding.

BACKGROUND OF THE INVENTION

In the case of a ski binding of this type known from DE 26 60 145 C2, the plate, which is suitable for touring, is locked in its rear region in relation to two retaining clips fastened to the ski by means of two laterally arranged locking elements. In order to release the plate for the touring position, said locking elements have to be displaced or pivoted.

An advantage of this arrangement of locking elements is that the latter are positioned within the binding region, i.e. between the front sole holder and the rear heel holder. In comparison to conventional locking elements of touring plates, which locking elements can be fixed to the ski behind the heel holder, there is less distortion of the ski and a better transmission of force during skiing. However, the disadvantage of the known embodiment is that the plate has to be designed to be relatively stiff in order to show sufficient strength for downhill skiing and in order to prevent the plate from tipping in the front region in particular when the ski is tilted. This results in a low resistance to tipping, said resistance to tipping being necessary in particular for downhill skiing.

To date, there are either special touring bindings, with specific properties for touring and disadvantageous effects for downhill skiing, or there are downhill skiing bindings which have specific properties for downhill skiing but do not have any touring properties.

In recent times, a new skiing technique known under the term "free riding" is being increasingly used. In this case, as a rule, a wider ski than normal is used in order also to be able to travel off piste in deep snow. Great value is nevertheless placed on a stable behavior during skiing downhill, in particular on a large resistance to tipping. In order also to reach locations off piste, a touring property is also desirable, i.e. a possibility, by pivoting up the ski boot, to permit a cross-country running option, which generally presupposes a plate which also pivots.

The desirable specific properties of such a ski binding are contrary to each other, therefore there is not yet any satisfactory example of this in the prior art.

BRIEF SUMMARY OF THE INVENTION

It is therefore the object of the invention to provide a ski binding which, in addition to good touring properties, also provides unrestricted downhill skiing options without the resistance to tipping of the ski binding being impaired. Nevertheless, the ski binding is not to be substantially heavier than a conventional ski binding, i.e. the plate which also pivots is either to be flexible and/or to be able to be composed of a lightweight material.

This object is achieved according to the invention by the characterizing features of patent claim 1.

Advantageous embodiments of the invention are described in the subclaims.

The invention is therefore based on the general concept that, by means of the further locking element in the front region of the ski binding, in particular in the ball region of the ski boot, the plate is fixed to the ski in the manner of a conventional downhill ski binding and is stiffened, i.e. the plate, in the locked state, is anchored to the front and to the rear ends and also in between repeatedly to parts fixed on the ski.

Protection is claimed not only for the features indicated below or illustrated graphically but also for basically any desired combinations of the features stated or illustrated.

BRIEF DESCRIPTION OF THE SEVERAL VIEWS OF THE DRAWING(S)

Figure 2:
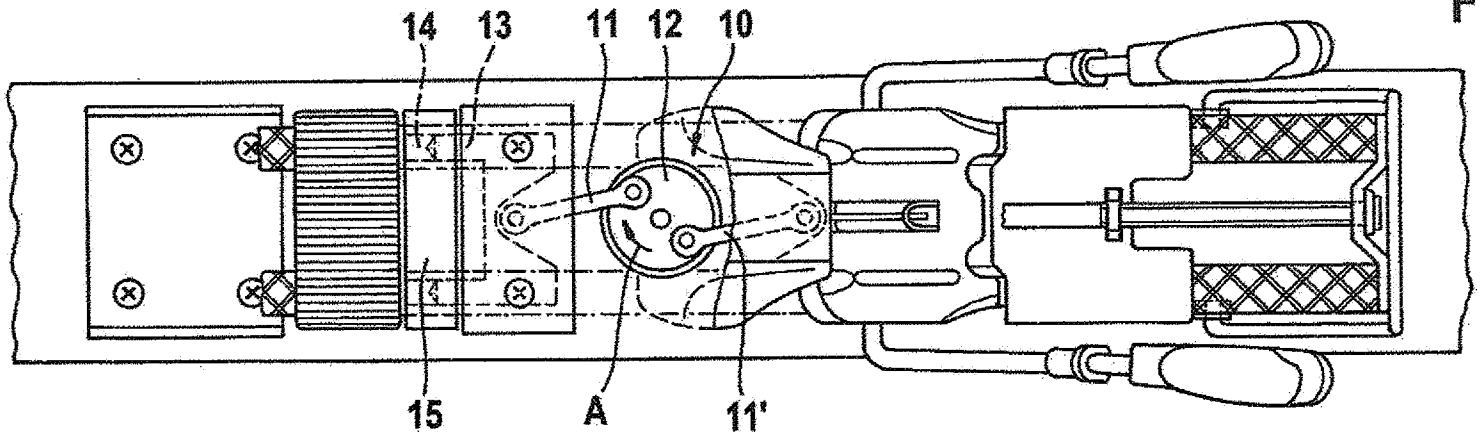
Figure 3:
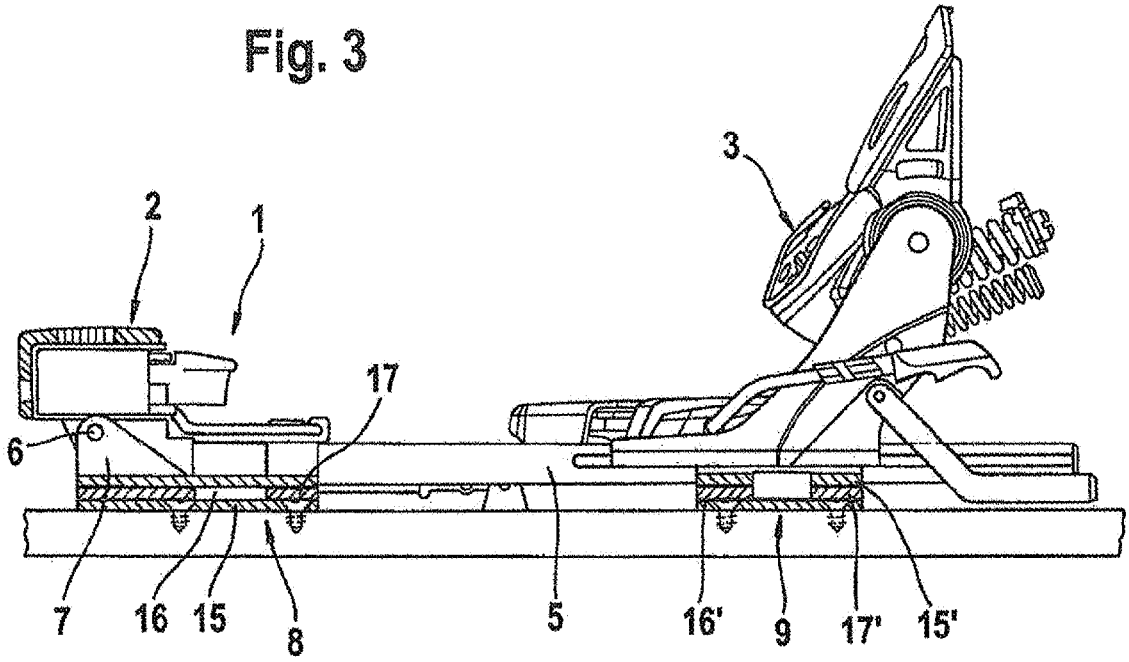
Figure 4:
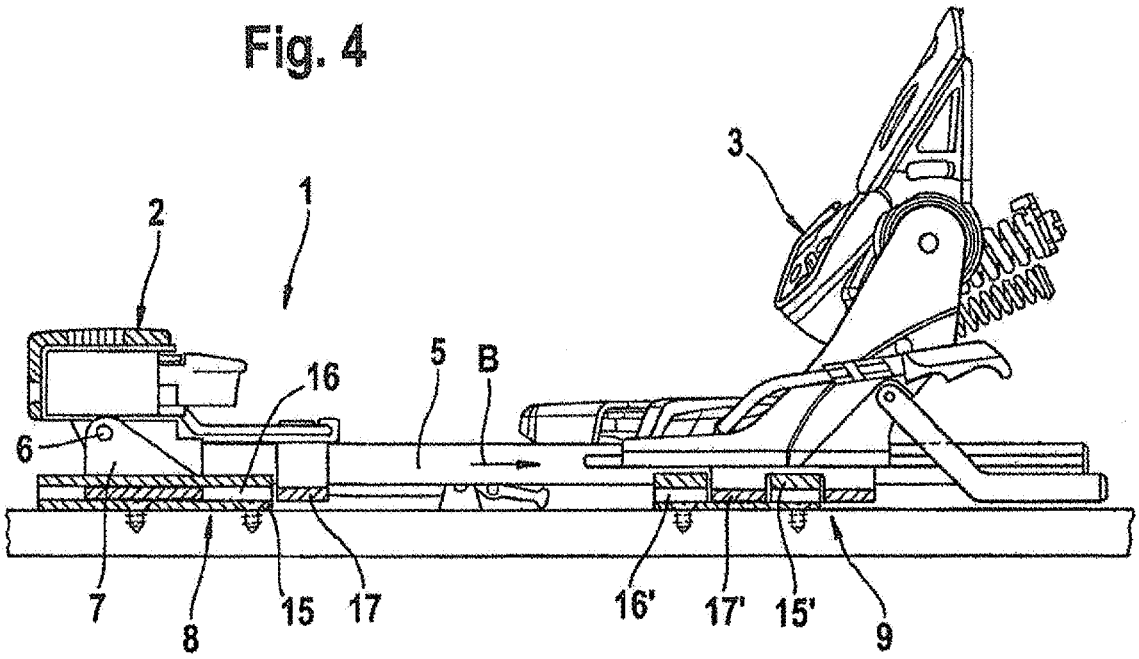
Figure 5:
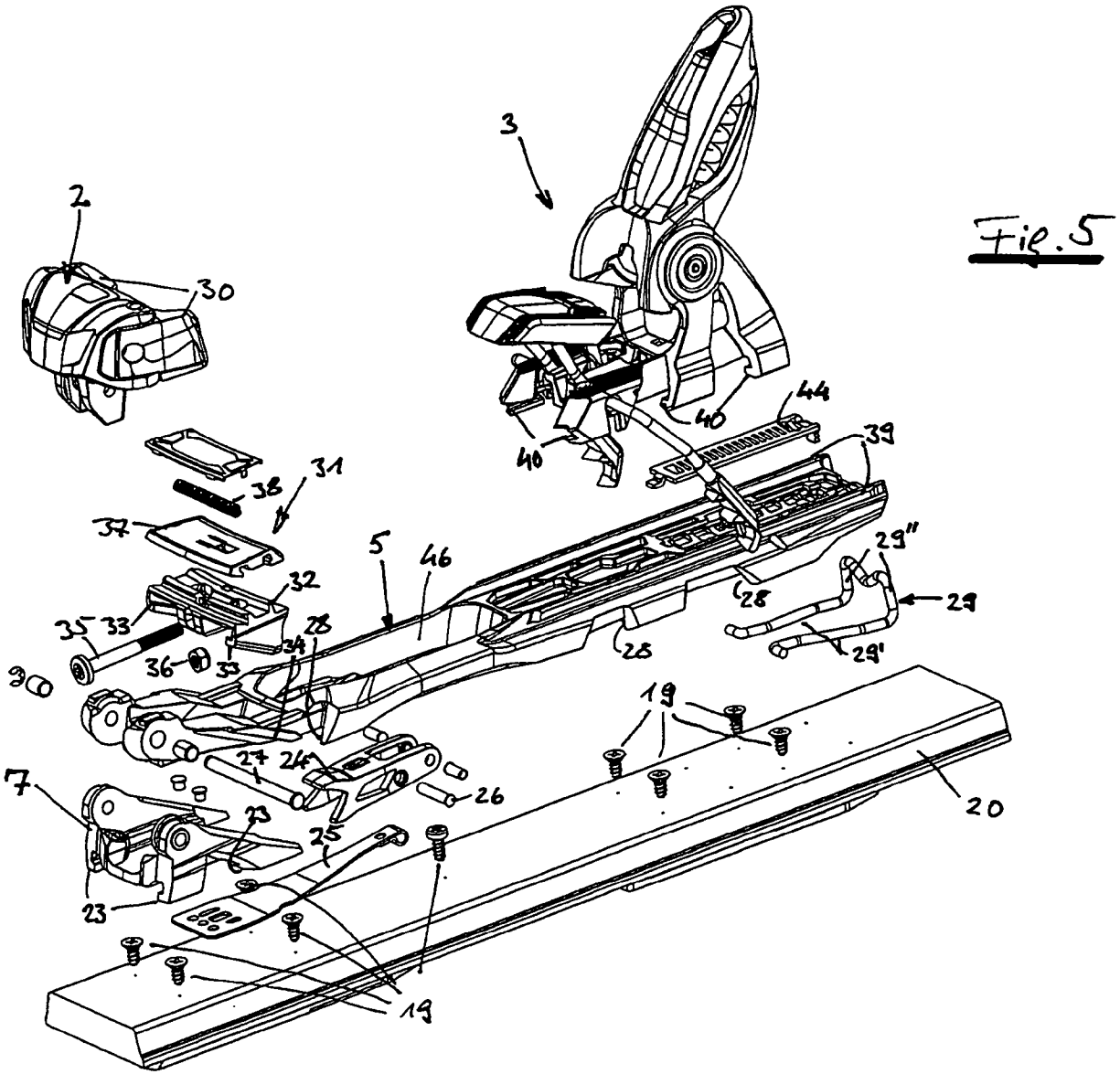
Figure 6:
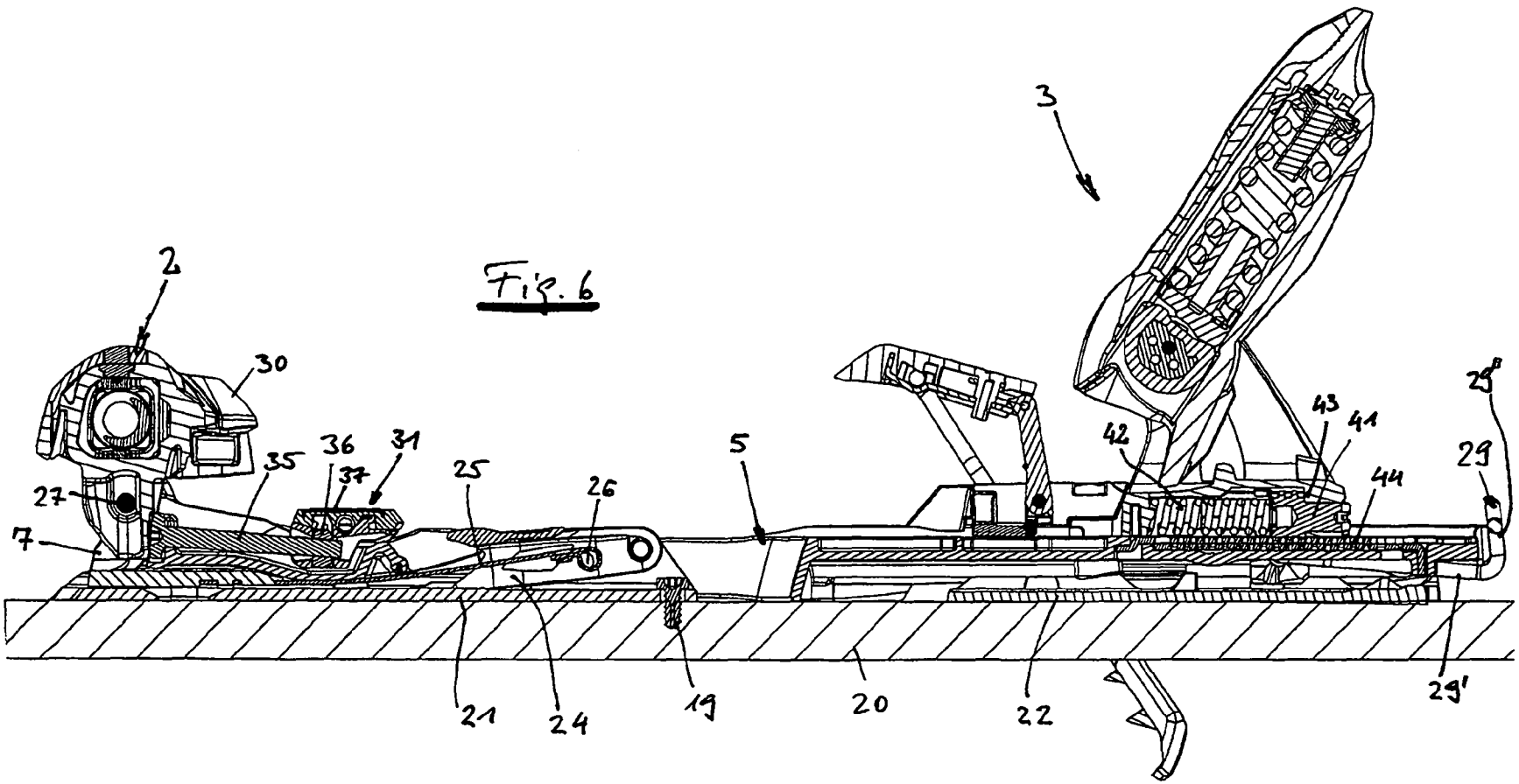
Figures 7, 8:
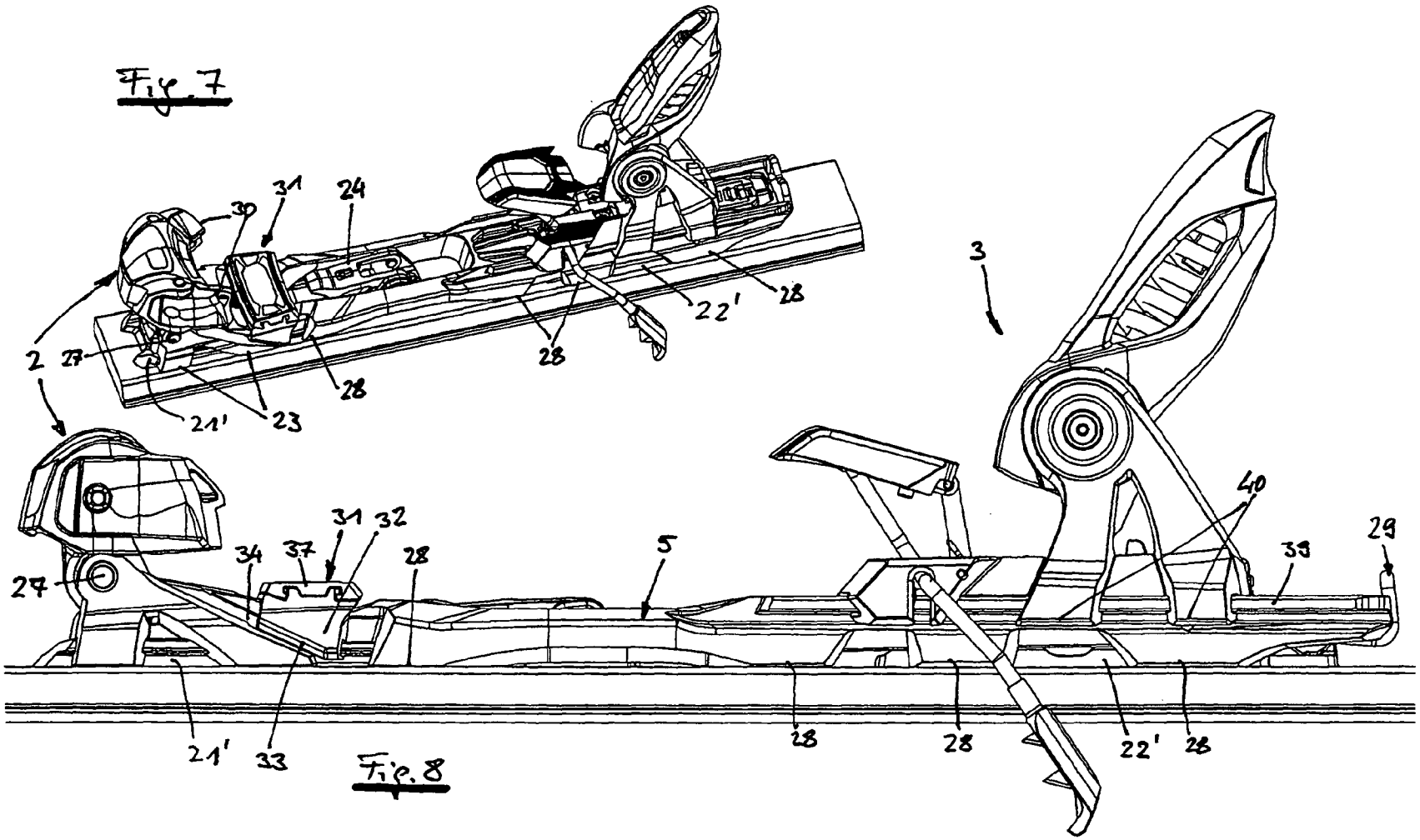
Figure 9:
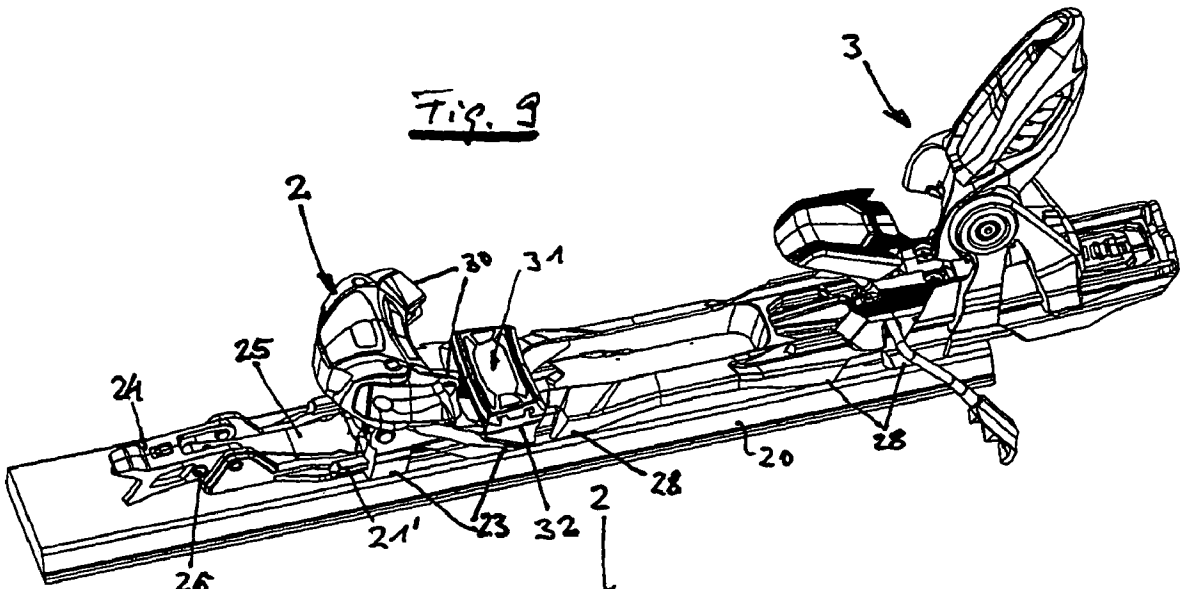
Figure 10:
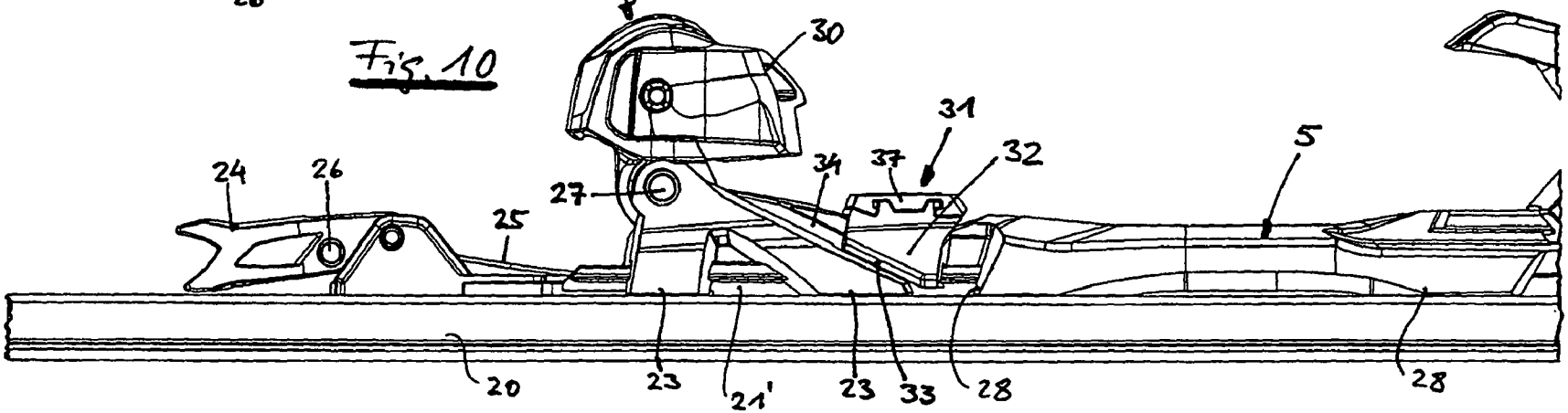
Figure 11:
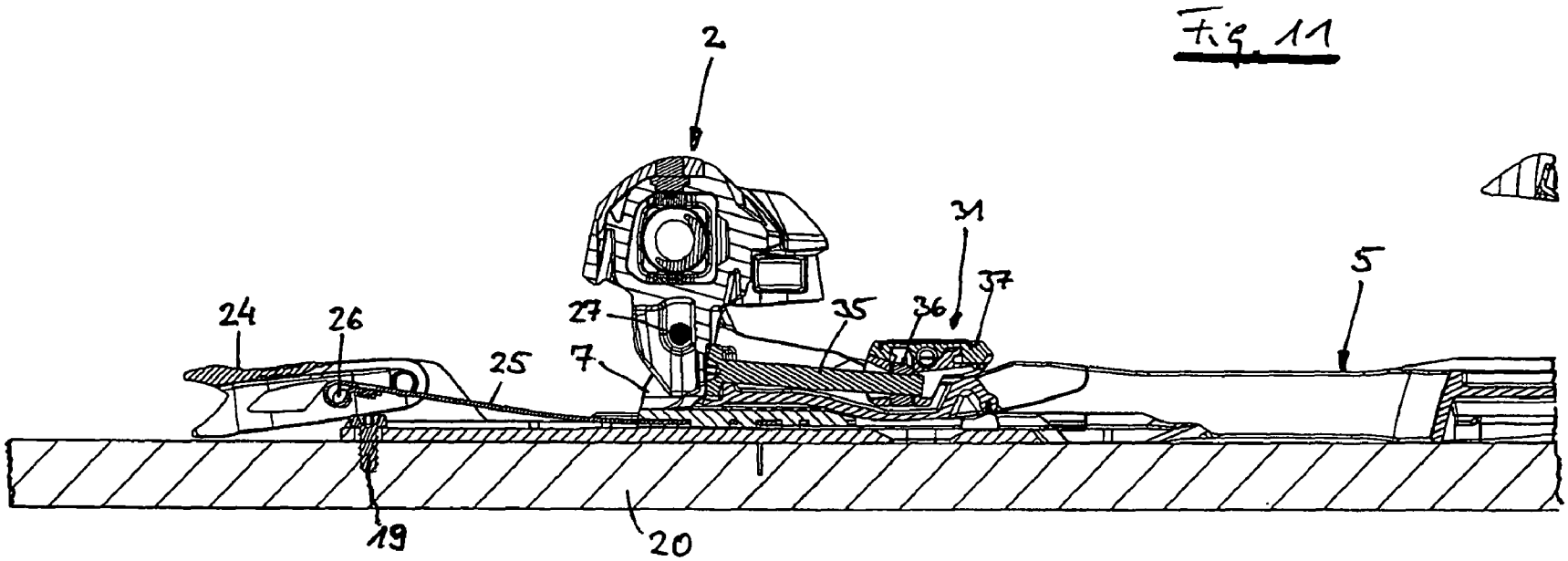

The invention is explained in more detail below with reference to the drawing, in which FIG. 1 shows a side view of a first embodiment of a ski binding according to the invention, FIG. 2 shows a top view of the exemplary embodiment according to FIG. 1, FIG. 3 shows a side view of a second exemplary embodiment in a locked position, FIG. 4 shows a side view according to FIG. 3 in an unlocked position, FIG. 5 shows an exploded illustration of a particularly preferred embodiment, FIG. 6 shows a vertical central longitudinal section of said embodiment, FIG. 7 shows a perspective illustration of said embodiment, FIG. 8 shows a side view of said embodiment, FIG. 9 shows a perspective illustration of one variant of said embodiment (with the lever 24 arranged at the front), FIG. 10 shows a side view of said variant, and FIG. 11 shows a vertical central longitudinal section of said variant.

DETAILED DESCRIPTION OF THE INVENTION

The ski binding 1 illustrated in FIG. 1 has a front sole holder 2 and a heel holder 3 which hold a sole 4 of a conventional downhill ski boot or of a touring ski boot on a plate 5. The release function, the mechanics and adjustability of said front sole holder 2 and of the heel holder 3 are basically known and are therefore not described in more detail here.

The plate 5 can be pivoted upward about a front axis 6, as known per se. In this case, said axis 6 is arranged transversely with respect to the longitudinal direction of the ski below the front sole holder 2 on a bearing part 7 fixed on the ski. In order to achieve said pivotability of the plate 5, the rear end of the plate 5 has to be freely movable upward in the arrow direction "T", i.e. has to be able to be positioned from a locked position into an unlocked position.

In the exemplary embodiment illustrated in FIG. 1, the ski binding 1 according to the invention therefore has front locking elements 8 and rear locking elements 9 which are arranged below the plate 5. The locking elements comprise a lever mechanism 10 which is arranged on the ski and has two connectors 11, 11' which are fixed at their one end on a rotary disk 12 and at their other end on locking pins 13, 13'.

The front locking element 8 is preferably arranged below the ball region of the boot sole and the rear locking element 9 is preferably arranged below the heel region in order to permit a good transmission of force to the ski. This arrangement has the further advantage that the locking elements are located within the binding region or the region of the boot sole and not outside it, and therefore there is virtually no negative influence on the natural sag of the ski.

Recesses 14, 14', in which the locking pins 13, 13' engage in order to lock the plate 5 to the ski, are now provided in bearing elements 15, 15' on the plate 5. Of course, instead of two recesses and locking pins, as illustrated in FIG. 1, just one recess and in each case one locking pin can also be provided. The locking pin may also have a different shape than shown in the exemplary embodiment.

In order to unlock the plate 5 for touring, the rotary disk 12 merely has to be rotated in the direction of rotation "A" (see FIG. 2). In the process, the connectors 11, 11' which are fixed to the rotary disk 12 are rotated at the same time and therefore the locking pins 13, 13' are synchronously pushed out of the recesses 14, 14'. The locking elements 8 and 9 are then unlocked, and the plate 5 can be pivoted together with the boot in the arrow direction "T" for touring. In order to lock the plate 5 again for skiing downhill, the operation has to take place in the opposite sequence to the sequence described previously. In order to be able to easily actuate the rotary disk 12, the latter has a handle (not illustrated specifically) which can protrude laterally from the ski binding. Of course, other operating means are also possible without departing from the scope of the present invention.

FIGS. 3 and 4 illustrate a further exemplary embodiment in which the ski binding 1 likewise has front locking elements 8 and rear locking elements 9. However, in contrast to the exemplary embodiment described previously, here the entire plate 5 is displaced out of the bearings 15, 15' fixed on the ski or out of the recesses 16, 16' thereof in the longitudinal direction of the ski (see arrow "B"). In the process, the locking webs 17, 17' which are fastened below the plate are displaced out of the locked position, which is illustrated in FIG. 3, for downhill skiing into the unlocked position which is illustrated in FIG. 4, for touring skiing such that a pivoting of the plate upward is also possible here.

In order to be able to displace the locking webs 17, 17' and therefore also the plate 5 in the arrow direction "B" and vice versa, a lever mechanism (not illustrated specifically) is provided which, as in the case of the exemplary embodiment according to FIG. 1, may be formed from a crank mechanism but also from any other adjusting mechanism. Furthermore, it is also possible in this exemplary embodiment to also only provide one locking element, for example in the central region of the plate.

It is pointed out that the present invention is not restricted to the embodiment described and illustrated but that modifications apparent to a person skilled in the art are also to be included.

With reference to FIGS. 5 to 11, a particularly preferred embodiment is described below, in which use is made very substantially of the construction principles illustrated with reference to FIGS. 3 and 4.

Two flexible base plates 21 and 22 (not illustrated in FIG. 5) are fastened consecutively in the longitudinal direction of the ski to the ski 20 by means of screws 19 and are designed in such a manner that they do not provide any significant resistance to flexing movements of the skis 20. Guide rails 21' and 22' are integrally formed on said base plates 21 and 22, said guide rails being, for example, in the form of angled profiles with in each case a vertical leg integrally formed on the associated base plate 21 or 22 and a horizontal leg integrally formed on the upper edge of the vertical leg, with it being possible for said horizontal legs to point outward in directions facing away from each other. The bearing part 7 is guided in a longitudinally displaceable manner on the guide rails of the front base plate 21 in the longitudinal direction of the ski. For this purpose, the bearing part 7 has guide elements 23 which are formed in an essentially complementary manner to the guide rails and which engage around and below the abovementioned horizontal legs of the guide rails such that the bearing plate 7 is secured on the front base plate 21 in a virtually play-free manner by means of a form-fitting connection to the guide rails in the transverse and vertical directions.

The bearing part 7 can be displaced by means of a hand lever 24 between a front end position in the longitudinal direction of the ski and a rear end position in the longitudinal direction of the ski when the hand lever is folded over from its one position resting on the top side of the ski into the other position resting on the top side of the ski. The hand lever 24 is mounted pivotably about an axis parallel to the transverse axis of the ski on small bearing blocks arranged fixedly on the front base plate 21 or on the top side of the ski, and forms an assembly in the manner of a toggle lever together with a leaf spring 25, the one end of which is connected fixedly to the bearing part 7 and the other end of which is coupled to the hand lever 24 by means of a transverse axis 26. The leaf spring 25 is designed with a certain amount of prestressing in such a manner that the leaf-spring end connected to the hand lever 24 in an articulated manner attempts to tension the hand lever 24 in each case into a position in which it is placed onto the upper side of the ski, with the toggle lever assembly formed from the leaf spring 25 and the hand lever 24 being in a dead-center position or position beyond the dead center when the hand lever 24 is placed in the one or other direction onto the top side of the ski. Accordingly, the bearing part 7, depending in each case on the end position which is taken up by the hand lever 24 and which rests on the top side of the ski, is secured immovably in the front or rear position in the longitudinal direction of the ski.

The standing plate 5 is arranged on the bearing part 7 in a manner such that it can pivot about the transverse axis 27. In this case, the standing plate 5 is secured virtually immovably on the top side of the ski when, with the standing plate 5 placed onto the top side of the ski, the bearing part 7 is displaced out of its rear end position in the longitudinal direction of the ski into the front end position in the longitudinal direction of the ski.

During this forward displacement of the standing plate 5 placed onto the upper side of the ski, guide elements 28 which are arranged on the lower side of the standing plate 5 and are formed in a similar manner to the guide elements 23 of the bearing part 7, interact in a locking manner with the horizontal webs of the guide rails 21' on the front base plate 21 and with identical guide rails 22' on the base plate 22. If the standing plate 5 is placed onto the top side of the ski in the rear position of the bearing part 7 in the longitudinal direction of the ski, the guide elements 28 arranged in the vicinity of the front end of the standing plate 5 take up a position behind the rear ends, in the longitudinal direction of the ski, of the guide rails 21' of the front base plate 21 while the guide elements 28, which are arranged further to the rear, of the standing plate 5 each take up a position at corresponding cutouts of the horizontal legs of the guide rails 22' of the rear base plate 22. If the bearing part 7 is now displaced forward in the longitudinal direction of the ski by the hand lever 24 being folded over from its one position resting on the top side of the ski through approximately 180.degree. into its other position resting on the top side of the ski, then the guide elements 28 are each displaced into a position in which they engage around and under the horizontal webs of the guide rails 21' and 22' of the base plates 21 and 22 such that the standing plate 5 is secured on the base plates 21 and 22 in a manner such that it is free from play in the transverse and vertical directions, but remains displaceable in the longitudinal direction of the ski. This displaceability in the longitudinal direction of the ski is of importance for flexing movements of the ski. Since the standing plate 5 is at a more or less large vertical distance from the neutral bending zone of the ski, during flexing movements of the ski relative displacements inevitably occur in the longitudinal direction of the ski between the standing plate 5 and the base plates 21 and 22, with, in particular, the relative movements between the rear base plate 22 and the standing plate 5 being relatively large because the region of the rear base plate 22 is at a relatively large distance from the bearing plate 7 which is secured in a virtually immovable manner by the leaf spring 25 and the hand lever 24 resting on the top side of the ski.

As soon as the bearing part 7 has been adjusted by means of the hand lever 24 into its rear position in the longitudinal direction of the ski, the standing plate 5 takes up its state, as desirable for touring, in which it can be pivoted upward about the transverse axis 27 relative to the ski 20, i.e. can be raised from the top side of the ski. After the standing plate 5 is raised from the top side of the ski, a supporting clip 29 can be pivoted from the inoperative position, illustrated in FIG. 6, into a first or second latchable operative position by pivoting in the clockwise direction through approximately 90.degree. or 180.degree. in the clockwise direction. In the first operative position, the heel-side end of the standing plate 5 is supported at a distance, which is predetermined by the length of the long leg 29' of the supporting clip 29, from the upper side of the rear base plate. This is advantageous in particular if very steep slopes are to be overcome during the touring. In the second operative position, i.e. when the supporting clip 29 has been pivoted from the inoperative position of FIG. 6 through 180.degree. in the clockwise direction, the heel-side end of the standing plate is supported in relation to the top side of the rear base plate 22 or the top side of the ski at a distance predetermined by the length of the short leg 29" of the supporting clip 29. This setting is selected if comparatively shallow slopes are to be overcome during touring.

Since, during touring, i.e. with the standing plate 5 pivoted up relative to the ski 20, the bearing part 7 takes up its rear position in the longitudinal direction of the ski, it is readily ensured that the center of gravity of the ski 20 is located in the longitudinal direction of the ski in front of the transverse axis 27, about which the standing plate 5 pivots on the bearing part 7, and always attempts to drop the ski tip downward when the skier lifts the foot and therefore the respective ski. The above-mentioned center of gravity position of the ski is advantageous in particular for kick turns or similar maneuvers.

If appropriate, depressions can be arranged on the top side of the rear base plate 22, into which the supporting clip 29 can be lowered when placed onto the base plate 22. As a result, the standing plate 5 which is placed onto the base plate 22 by the supporting clip 29 obtains increased stability in the transverse direction of the ski.

The front sole holder arrangement 2 is fastened together with the standing plate 5 to the bearing part 7 by the transverse axis 27, with a securing of the housing of the front sole holder arrangement 2 in a stationary manner relative to the standing plate 5 being ensured by a form-fitting connection between the housing of the sole holder arrangement 2 and the front end of the standing plate 5. If a ski boot is inserted into the ski binding 1, the front sole end of the ski boot is secured by the sole holders 30 of the front sole holder arrangement 2, with the sole holders 30 engaging around or over the front sole end laterally and from above. Ski boots for downhill skiing have standard thicknesses, and therefore, by means of corresponding adaptation of the shape of the sole holders 30, vertical play-free securing can readily be ensured. The conditions for touring ski boots are different. In this case, in comparison to boots for downhill skiing, the sole thicknesses may differ greatly. The front sole holder arrangement 2 is therefore combined with a supporting arrangement 31 which can be adjusted in the vertical direction. Said supporting arrangement has a slide 32 which is guided displaceably by means of lateral guide elements 33 on lateral guide webs 34 of the standing plate 5. The guide webs 34 are arranged obliquely with respect to the plane of the standing plate 5 such that, during longitudinal displacement in the direction of the guide webs 34 relative to the standing plate 5, the slide 32 is also adjusted in the vertical direction. The position of the slide 32 on the guide webs 34 can be set by means of an adjusting screw 35, the head of which is mounted axially and radially on the bearing part 7 and the threaded section of which is screwed into a nut 36 which is secured on the slide 32 radially and axially with wobbling mobility.

A slide plate 37 which can be displaced in the transverse direction is arranged on the top side of the slide 32 and is tensioned into a central position by means of a helical compression spring 38. The slide plate 37 is preferably guided on the slide 32 on a curved path, the center of which drops into the heel region of the ski boot. By means of appropriate selection of the materials, it can readily be ensured that the slide plate 37 can be displaced smoothly on the slide 32. The front end of the ski boot sole is then also supported relative to the front sole holder arrangement 2 with smooth mobility in the transverse direction, as is desirable for a satisfactory release function of the front sole holder arrangement 2. This smooth displaceability is ensured even if the lower side of the boot sole is to have an anti-slip rubber profile.

The heel holder arrangement 3, which, according to FIG. 5, is combined with a ski break arrangement, is arranged displaceably in the longitudinal direction on the standing plate 5. For this purpose, lateral guide webs 39 are arranged on the standing plate 5 and interact in a form-fitting manner with guide elements 40, i.e. the heel holder arrangement 3 is secured in a play-free manner in the vertical and sideways directions on the guide webs 39. The securing of the heel holder arrangement 3 in the longitudinal direction of the standing plate 5 takes place by means of an adjusting screw 41 which is mounted rotationally within a housing part of the heel holder arrangement 3 and is tensioned by a thrust spring 42 against a stop 43 fixed on the housing. The adjusting screw 41 has a worm-like external threaded section, the threaded web of which engages in transverse slots of a toothing belt 44 which is arranged nondisplaceably on the top side of the standing plate 5 below the housing of the heel holder arrangement 3, which housing can be displaced in the guide webs 39. For this purpose, the toothing belt 44 engages with angled ends in corresponding recesses on the top side of the standing plate 5. By means of a rotational adjustment of the adjusting screw 41, the adjusting screw 41 is displaced together with the heel holder arrangement 3 on the toothing belt 44 and therefore in the longitudinal direction of the standing plate 5. Accordingly, the heel holder arrangement 3 can be positioned in a manner matched to the respective length of the ski boot sole. In this case, the heel holder arrangement 3 remains displaceable relative to the adjusting screw 41 counter to the tensioning force of the thrust spring 42, which is designed as a helical compression spring, such that the ski boot sole can be clamped in a play-free manner in the longitudinal direction of the sole in such a manner that the thrust spring 42 keeps the heel-side sole holder 45 resiliently in contact with the rear sole end in a basically known manner.

As can be gathered in particular from FIGS. 7 and 8, firstly, and FIGS. 9 and 10, secondly, the hand lever 24 can be arranged in front of or behind the bearing part 7 in the longitudinal direction of the ski. When it is arranged behind the bearing part 7, there has to be a corresponding cutout 46 in the standing plate 5 in order to be able to accommodate the hand lever 24 in a pivotably adjustable manner on the top side of the ski or on the top side of the front base plate 21.

The invention claimed is:

1. A ski binding which is suitable for downhill skiing and also for touring, comprising:

a plate which is arranged in its front region on a bearing part in a manner such that it can be pivoted upward about an axis lying transversely with respect to a longitudinal direction of the ski, and on which a front ski binding and a rear heel holder are fastened in order to secure a ski boot or touring boot;

wherein the plate can be fastened in its rear region via at least one locking element to an abutment attached to the ski, and the at least one locking element is arranged in front of or in the region of the rear heel holder;

wherein the bearing part is displaceable between a front end position and a rear end position in the longitudinal direction of the ski by an actuating mechanism; and in that, when the plate is pivoted down onto a top side of the ski and the bearing part is displaced forward, the at least one locking element, being one of a plate-side locking element and a ski-side locking element, is configured to enter into locking engagement with sections of at least one of a ski-side and plate-side mating elements such that the plate can be selectively locked to the ski in the transverse and vertical directions, the at least one locking element being arranged below a ball region of the ski boot and below a heel region of the ski boot and anchoring the plate to the ski at more than one longitudinal location.

2. The ski binding as recited in claim 1, wherein the at least one locking element further comprises a front locking element arranged below the ball region of the ski boot and a rear locking element arranged below the heel region of the ski boot.

3. The ski binding as claimed in claim 2, wherein the front and rear locking elements comprise at least one of a locking pin and a locking web that engage in recesses of at least one bearing element.

4. The ski binding as claimed in claim 2, wherein the front and rear locking elements are arranged below the plate.

5. The ski binding as claimed in claim 2, wherein the front and rear locking elements engage laterally around the plate.

6. The ski binding as claimed in claim 2, wherein the front and rear locking elements are together brought, via a lever mechanism, from a locked position into an unlocked position, and vice versa.

7. The ski binding as claimed in claim 6, wherein the lever mechanism is arranged below the plate and has an actuating lever which, for actuation, protrudes laterally from the ski binding.

8. The ski binding as claimed in claim 6, wherein the lever mechanism comprises a crank mechanism.

9. The ski binding as claimed in claim 8, wherein the lever mechanism comprises a connector arranged on a rotary disk.

10. The ski binding as claimed in claim 6, wherein the front and rear locking elements are actuated synchronously via the lever mechanism.

11. The ski binding as claimed in claim 6, wherein the lever mechanism is designed in the manner of a toggle lever mechanism.

12. The ski binding as claimed in claim 1, wherein one end of a leaf spring extending essentially in the horizontal direction is fastened to the bearing part, as part of a toggle lever assembly, the other end of said leaf spring is tensioned against the top side of the ski and is connected in an articulated manner to a lever which can be pivoted about a transverse axis fixed on the ski and, for its part, can be adjusted pivotally between its end positions resting on the top side of the ski.

13. The ski binding as claimed in claim 1, wherein a supporting clip is mounted below the plate in a manner such that it can pivot about a transverse axis, said supporting clip being pivotable from an inoperative position, in which the supporting clip bears against a lower side of the plate and protrudes with its free end over the rear end of the plate, into at least one operative position, in which the supporting clip protrudes essentially vertically from the lower side of the plate such that the plate, in a position in which it is correspondingly pivoted upward, can be supported on the ski.

14. The ski binding as claimed in claim 13, wherein the supporting clip can be pivoted into a further operative position, in which the supporting clip bears against the lower side of the plate and points with its free end in the direction of the front end of the plate, with an angled portion arranged at the free end of the supporting clip protruding essentially vertically from the lower side of the plate such that the plate, in a position in which it is correspondingly pivoted upward, can be supported on the ski.

15. The ski binding as claimed in claim 14, wherein a leg of the supporting clip which is effective as a support in the former operative position is, in terms of size, approximately three times the length of the angled portion.

16. The ski binding as claimed in claim 1, wherein the front ski binding is assigned a height-adjustable supporting arrangement for the front region of the boot sole, the supporting arrangement having a standing surface, which can be displaced smoothly in the transverse direction, for the boot sole.

17. The ski binding as claimed in claim 1, wherein the at least one locking element independently anchors the plate to the ski at different longitudinal locations along the plate to thereby stiffen the ski including at a location positioned away from both a front end of the plate and a rear end of the plate.

18. The ski binding as claimed in claim 17, wherein the at least one locking element anchors the plate to the ski at the front end of the plate, at the rear end of the plate, and at a location therebetween.

19. The ski binding as claimed in claim 18, wherein the at least one locking element moves longitudinally between an engaged position and a disengaged position with respect to the at least one mating element.

20. The ski binding as claimed in claim 1, wherein when the plate is selectively locked to the ski, the bearing part is locked in place against rotation and in the transverse and vertical directions with respect to the ski at the axis by way of the at least one locking element.

* * * * *